United States Patent [19]

Denhart

[11] 4,158,898

[45] Jun. 26, 1979

[54] ADJUSTABLE SUPPORT FOR THE FORWARD EDGE OF A WALL SUPPORTED WASHSTAND

[76] Inventor: Norbert J. Denhart, 2845 Westonridge Dr., Cincinnati, Ohio 45239

[21] Appl. No.: 894,590

[22] Filed: Apr. 7, 1978

[51] Int. Cl.[2] ..... A47K 1/04; E03C 1/32

[52] U.S. Cl. ..... 4/170; 4/167; 4/187 A; 248/188.4; 248/188.6

[58] Field of Search ..... 4/166, 167, 168, 169, 4/170, 187 R, 187 A, 188; 52/34, 35; 248/157, 188.4, 188, 188.6, 188.1

[56] References Cited

U.S. PATENT DOCUMENTS

| | | | |
|---|---|---|---|
| 1,520,983 | 12/1924 | Taylor | 248/188.6 |
| 1,806,169 | 5/1931 | Kohler, Jr. | 248/188.4 |
| 2,338,092 | 1/1944 | Brown | 248/188.4 X |
| 2,535,613 | 12/1950 | Vanderbeek | 248/188.4 |
| 3,917,073 | 11/1975 | Kulkey | 248/188.6 |
| 3,991,530 | 11/1976 | Scourtes | 4/172.19 X |
| 4,036,371 | 7/1977 | Michel | 248/188.4 X |

*Primary Examiner*—Henry K. Artis
*Attorney, Agent, or Firm*—John G. Schenk

[57] ABSTRACT

Floor supported vertically adjustable means are provided for engaging the underside of the front lip of a wall-mounted washstand for providing positive support therefor of such a nature as to fully support the forward edge in such a manner as to effectively prevent damage to or removal of the washbowl.

9 Claims, 4 Drawing Figures

FIG-1
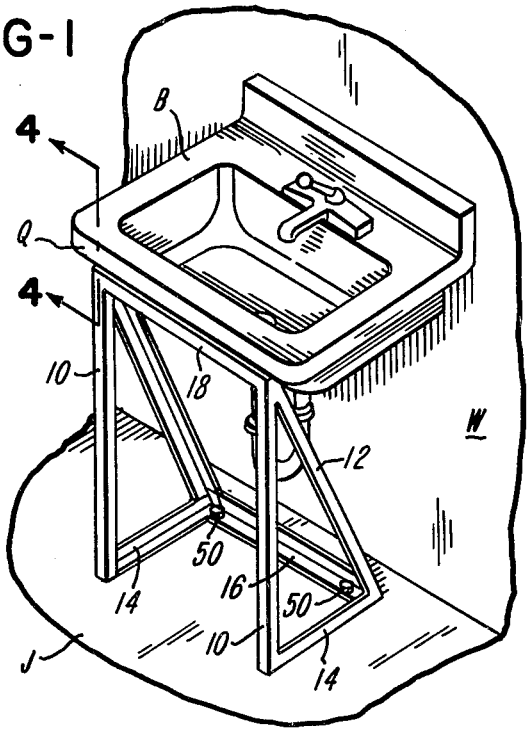
FIG-2
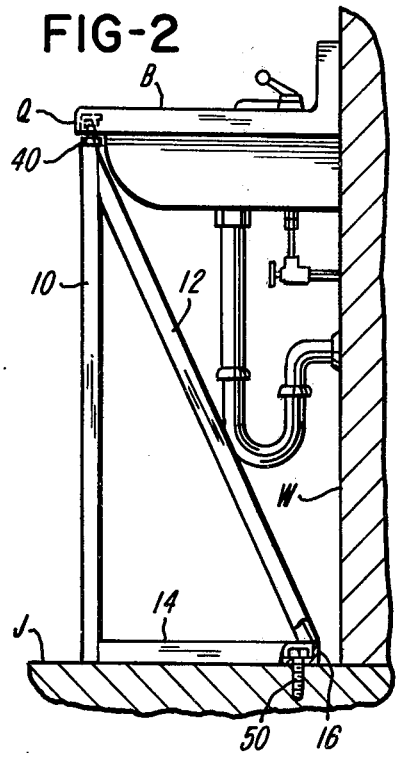
FIG-3
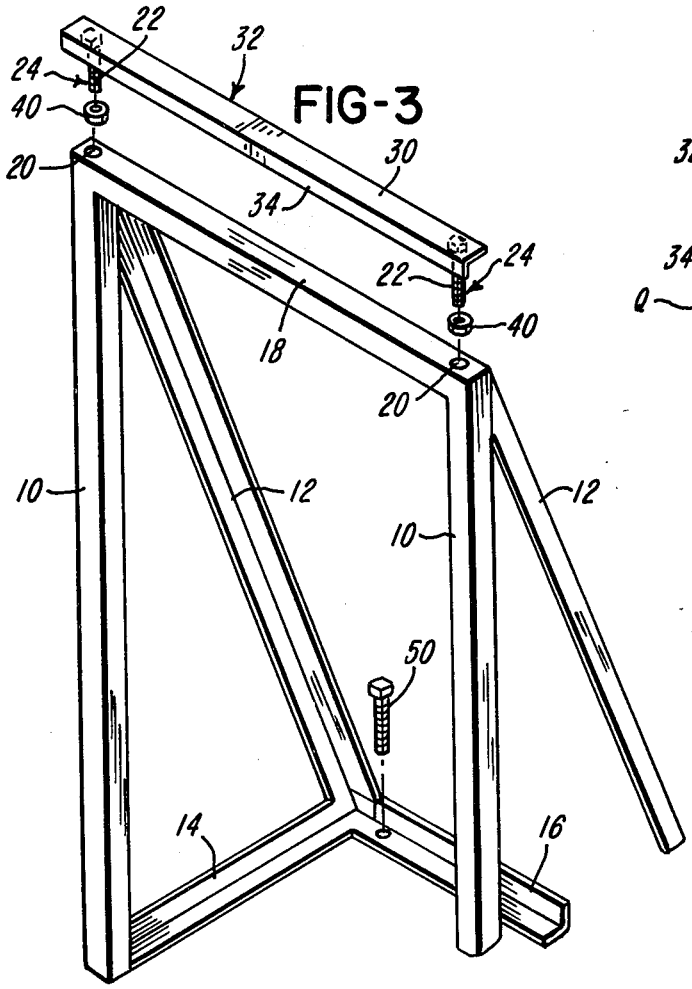
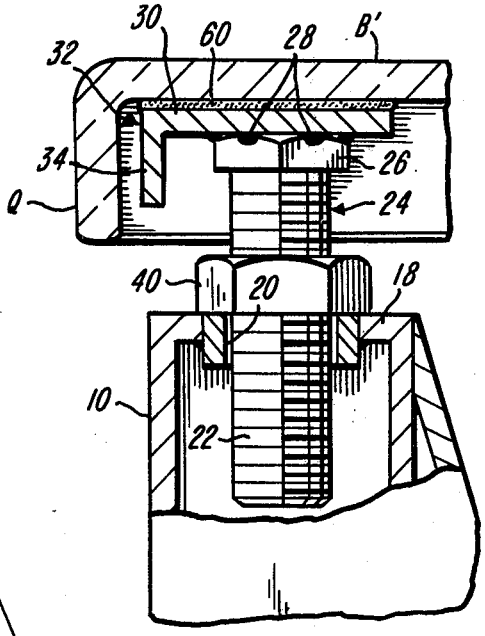
FIG-4

ADJUSTABLE SUPPORT FOR THE FORWARD EDGE OF A WALL SUPPORTED WASHSTAND

BACKGROUND OF THE INVENTION

Wall-mounted washstands are in widespread use, and it is not uncommon for such washstands to be subjected to abuse by over-loading, such as, by way of example, the weight of a person sitting or standing on the washstand which results in loosening of the washstand from the supporting wall. Such abuse often results in damage to or actual severing of the water lines and/or sewer connection resulting in water damage to the premises.

The aforesaid abuse is, unfortunately, rather common, particularly in low income housing projects, with the result that maintenance and upkeep costs are substantial.

The adjustable washbowl support of the present invention provides simple yet highly effective means for effectively supporting the forward edge of a wall-mounted washbowl in such a manner as to fully support the forward edge whereby to effectively resist deflection under any load applied to the washbowl such as, by way of example, would be occasioned by the weight of a person sitting or standing on the washbowl.

BRIEF DESCRIPTION OF THE DRAWINGS

FIG. 1 is a perspective view illustrating an adjustable washbowl support which embodies the teachings of the present invention operably associated with a wall-supported washstand.

FIG. 2 is a side view partly in section of FIG. 1.

FIG. 3 is a perspective view of the support, per se, of the present invention.

FIG. 4 is a view taken on line 4—4 of FIG. 1 illustrating a detail of the invention.

DESCRIPTION OF THE PREFERRED EMBODIMENTS

The stand comprises a pair of laterally spaced forward vertical legs 10 the upper ends of which are secured to the upper ends of a pair of rearwardly and downwardly inclined rear legs 12. The lower ends of legs 10 and 12 are maintained in fixedly spaced relationship by means of a pair of side legs 14, and the rear ends of inclined legs 12 are also rigidly interconnected by means of a bottom rear leg 16.

An upper, forward, horizontal, transverse support leg 18 is disposed in fixed spanning relationship with the upper ends of legs 10 and 12 and a pair of bolt receptive apertures 20 are provided in the outer or end-adjacent portions of leg 18 for the reception of the externally threaded portion 22 of a stud or bolt 24, the head 26 of which is rigidly connected such as, by welding or the like, 28, to the under surface of the horizontal leg 30 of an L-shaped rail 32 the vertical leg 34 of which depends for thereby concealing head 26 as clearly illustrated in FIG. 4.

The horizontal rail 32 comprises a vertically adjustable transverse member the upper surface of the horizontal leg 30 of which is dimensioned and adapted to underlie and engage the undersurface of the forwardly projecting lip B′ of the lavatory bowl, see FIG. 4.

An internally threaded adjustment nut 40 will raise or lower the elevation of the transverse member 30 relative to transverse support leg 18 of the stand.

The stand is initially positioned relative to and beneath the undersurface of the forwardly extending edge B′ of the washstand or lavatory B after which the rear ends of the side legs 14 or the end-adjacent ends of the rear leg 16 are securely anchored to the floor or other supporting surface J such as by means of lag bolts or screws 50.

The adjustable transverse member 30 is then elevated incident to manipulation of nuts 40 into contacting relationship with the undersurface of front edge Q of the washstand.

In the preferred embodiment of the invention a suitable epoxy or sealant 60 (FIG. 4) is applied to the upper surface of the horizontal transverse member 30 whereby to provide a positive bond between the undersurface of forward lip B′ of the washstand B and the upper surface of member 30 for thereby securely and permanently anchoring the support stand relative to the washstand to effectively and positively preclude relative motion between the support and washstand.

From the foregoing it will be noted that I have thus provided simple yet highly effective means for preventing damage to the conventional means by which a wall-mounted lavatory basin or washstand is secured to a vertical support wall W, by reason of or incident to the application of over-loads to the device by precluding relative movement of the forwardly projecting portions of a washstand relative to a vertical wall or other mounting member to which the rear portion of the washstand is fastened.

What is claimed is:

1. A support stand adapted to support a wall-hung lavatory bowl of the type which includes a peripheral lip having an undersurface and which projects from the bowl along a forward edge of that bowl, the support stand comprising:

a floor-engaging support means adapted to be disposed beneath a wall-hung lavatory bowl, said support means including a horizontal upper support leg for disposition beneath a peripheral lip of a wall-hung lavatory bowl, said upper support leg having fastener-receiving apertures defined therein;

a horizontal support rail adapted to be disposed beneath a peripheral lip of a lavatory bowl and over said upper support leg;

adjustable means connecting said support rail to said support leg for selectively elevating said support rail for disposing said support rail in contacting relationship with an undersurface of a lavatory bowl lip, said adjustable means including a plurality of externally threaded fasteners fixedly secured to said support rail to project downwardly therefrom into said fastener-receiving apertures, and an internally threaded nut engaged on each fastener so that a lower surface of said nut contacts an upper surface of said upper support leg immediately adjacent said fastener-receiving apertures, so that elevation of said support rail can be raised or lowered relative to said upper support leg.

2. A support stand as called for in claim 1, wherein the floor-engaging support means is self sustaining.

3. A support stand as called for in claim 1, wherein the floor-engaging support means includes a pair of laterally spaced, substantially triangular, side members each including a forward, substantially vertical leg, a floor-engaging, substantially horizontal bottom leg at right angles to said vertical leg, and an upwardly and outwardly inclined rear leg which defines the hypotenuse of each triangular side member; said upper, supper leg being in fixed spanning relationship with the apex of each of said triangular side members and a lower, horizontal, transverse rear leg in fixed spanning relationship with the lower ends of the inclined rear legs.

4. A support stand as called for in claim 1 wherein said adjustable means includes a pair of externally threaded studs.

5. A support stand as called for in claim 3 wherein the support rail includes a substantially vertical depending front leg and a substantially horizontal top leg which has an upper and a lower surface, said externally threaded studs secured to and projecting downwardly from said lower surface and said upper surface adapted to engage the undersurface of the forward lip of the lavatory bowl, whereby said depending front leg substantially conceals at least a major portion of said externally threaded studs.

6. A support stand as called for in claim 3 wherein the forward vertical legs of the triangular side members are disposed in substantial vertical alignment with the undersurface of the forward lip of the wall-hung lavatory bowl and wherein the bottom leg extends along the floor beneath and in spaced relationship with respect to the bowl.

7. A support stand as called for in claim 6 which includes means for anchoring those portions adjacent the lower ends of the inclined rear legs of the triangular side members to a supporting floor surface.

8. A support stand as called for in claim 1 wherein a sealant-adhesive is interposed between the adjacent surfaces of the lip of the lavatory bowl and said support rail for positively interlocking said surfaces against relative movement.

9. A support stand as called for in claim 1 wherein the relationship of the stand to the forward edge of a lavatory bowl is such as to fully support said forward edge against any downward movement incident to the application of a load to said forward edge whereby to resist downward deflection of the lavatory bowl.

* * * * *